US009909778B2

(12) United States Patent
Rakowski et al.

(10) Patent No.: US 9,909,778 B2
(45) Date of Patent: Mar. 6, 2018

(54) FREEZE TOLERANT CONDENSATE TRAP

(71) Applicant: Allied Air Enterprises Inc., West Columbia, SC (US)

(72) Inventors: Mark Rakowski, West Columbia, SC (US); Jeff Gedcke, West Columbia, SC (US); Jody Smith, West Columbia, SC (US); Stuart Still, West Columbia, SC (US); Randy Palm, West Columbia, SC (US); Hany Roman, West Columbia, SC (US)

(73) Assignee: Allied Air Enterprises LLC, West Columbia, SC (US)

( * ) Notice: Subject to any disclaimer, the term of this patent is extended or adjusted under 35 U.S.C. 154(b) by 911 days.

(21) Appl. No.: 14/186,759

(22) Filed: Feb. 21, 2014

(65) Prior Publication Data

US 2015/0241083 A1 Aug. 27, 2015

(51) Int. Cl.
*F24F 13/22* (2006.01)

(52) U.S. Cl.
CPC ..... *F24F 13/222* (2013.01); *Y10T 29/49826* (2015.01); *Y10T 137/1189* (2015.04)

(58) Field of Classification Search
CPC ..... F24F 13/222
See application file for complete search history.

(56) References Cited

U.S. PATENT DOCUMENTS 4,502,500 A 3/1985 Upton
4,630,633 A 12/1986 Vallery
7,823,601 B2 * 11/2010 Nishimoto ..... E03C 1/288 137/247.21
2006/0156467 A1 * 7/2006 Mellon ..... E03C 1/12 4/679
2008/0017589 A1 * 1/2008 Taylor ..... E03B 7/006 210/757
2009/0056346 A1 3/2009 Zatarain
2011/0088162 A1 * 4/2011 Nellesen ..... E03B 1/04 4/679
2013/0205483 A1 * 8/2013 Lagobi ..... E03C 1/281 4/144.1

FOREIGN PATENT DOCUMENTS

WO 2007135430 A2 11/2007

* cited by examiner

*Primary Examiner* — Avinash Savani
*Assistant Examiner* — Aaron Heyamoto
(74) *Attorney, Agent, or Firm* — Hubbard Johnston, PLLC

(57) ABSTRACT

A condensation trap comprising an inlet chamber configured to receive condensate liquid through a receiving opening therein. The trap also comprises an internal chamber in fluid communication with the inlet chamber via a first internal opening defined by a sidewall shared by the inlet chamber and the internal chamber, the first internal opening located at an opposite end of the inlet chamber from the receiving opening. The trap also comprises an outlet chamber in fluid communication with the internal chamber via a second internal opening located at an opposite end of the internal chamber from the first internal opening. The trap also comprises a bleed orifice located in a sidewall shared by the internal chamber and the outlet chamber, wherein at least a portion of the bleed orifice is lateral to first internal opening.

16 Claims, 9 Drawing Sheets

FREEZE TOLERANT CONDENSATE TRAP

TECHNICAL FIELD

This application is directed, in general, to heating-cooling systems, and more specifically, to condensate traps for such systems.

BACKGROUND

Heating, ventilating and air conditioning (HVAC) systems, such as gas-fired HVAC systems, can generate condensate liquid (water) as a byproduct of the combustion process during heating operations. Typically, a condensate trap is included in the drain system of the HVAC system to prohibit flue gases from entering the drain system or the installed environment while allowing the condensate liquid to drain.

HVAC systems installed in an unconditioned environment can be subject to ambient temperature below freezing and therefore have the risk of the condensate liquid freezing within the condensate trap. Frozen condensate in the condensate trap can block the flow passageway of the condensate trap, which in turn, can prevent condensate being removed from the system. Under such conditions, further condensate liquid generated during the HVAC system's operation may back-up into in the drain system and other components of the system distill to the trap and potentially prevent the proper operation and/or cause damage to the system.

Often, to prevent condensate liquid from freezing in the condensate trap, electrical heating tape is applied to the condensate trap. Some disadvantages of using electric heat tape can include: the requirement for, and consumption of, electrical power to produce resistive heating by the electrical heating tape; the loss in ability to prevent condensate freezing if electrical power to the heating tape is lost; reliance on field personnel to properly install the heating tape; and the degradation and failure of the electrical heating tape over time. Similar limitation can exist for other heating devices that rely on heating generated via resistive heating (also referred to as Joule or Ohmic heating).

Therefore there is a need for a freeze tolerant condensate trap that does not suffer from the drawbacks of previous condensate traps or previous solutions to prevent condensate freezing in such traps.

SUMMARY

One embodiment of the present disclosure is a condensation trap. The trap comprises an inlet chamber configured to receive condensate liquid through a receiving opening therein. The trap also comprises an internal chamber in fluid communication with the inlet chamber via a first internal opening defined by a sidewall shared by the inlet chamber and the internal chamber, the first internal opening located at an opposite end of the inlet chamber from the receiving opening. The trap also comprises an outlet chamber in fluid communication with the internal chamber via a second internal opening located at an opposite end of the internal chamber from the first internal opening. The trap also comprises a bleed orifice located in a sidewall shared by the internal chamber and the outlet chamber, wherein at least a portion of the bleed orifice is lateral to first internal opening.

Another embodiment of the present disclosure is an HVAC system. The system comprises a heating subunit, wherein the heating subunit in operation, combusts fuel and generates condensate liquid as a byproduct of combustion. The system comprises a drainage system configured to receive the condensate liquid, wherein the drainage system includes the above-described condensate trap.

Another embodiment of the present disclosure is a method of manufacturing the above-described condensation trap. The method comprises providing a mold, the mold defining an enclosed cavity that includes spaces to accommodate. The enclosed cavity spaces include an inlet chamber configured to receive condensate liquid through a receiving opening therein. The enclosed cavity spaces include an internal chamber in fluid communication with the inlet chamber via an first internal opening defined by a sidewall shared by the inlet chamber and the internal chamber, the first internal opening located at an opposite end of the inlet chamber from the receiving opening. The enclosed cavity spaces include an outlet chamber in fluid communication with the internal chamber via a second internal opening located at an opposite end of the internal chamber from the first internal opening. The enclosed cavity spaces include a bleed orifice located in a sidewall shared by the internal chamber and the outlet chamber, wherein at least a portion of the bleed orifice is lateral to first internal opening.

BRIEF DESCRIPTION OF THE DRAWINGS

Reference is now made to the following descriptions taken in conjunction with the accompanying drawings, in which.

DETAILED DESCRIPTION

Embodiments of the present disclosure benefit from the recognition that a condensate trap constructed to fully or partially drain condensate liquid, when a HVAC system is not in a heating operation, can prevent the blockage of the trap by frozen condensate in the trap. As further disclosed herein, the condensate trap can be further constructed to mitigate flue gases from passing through the condensate drained trap when the HVAC system starts a new heating operation.

Figure 1A:
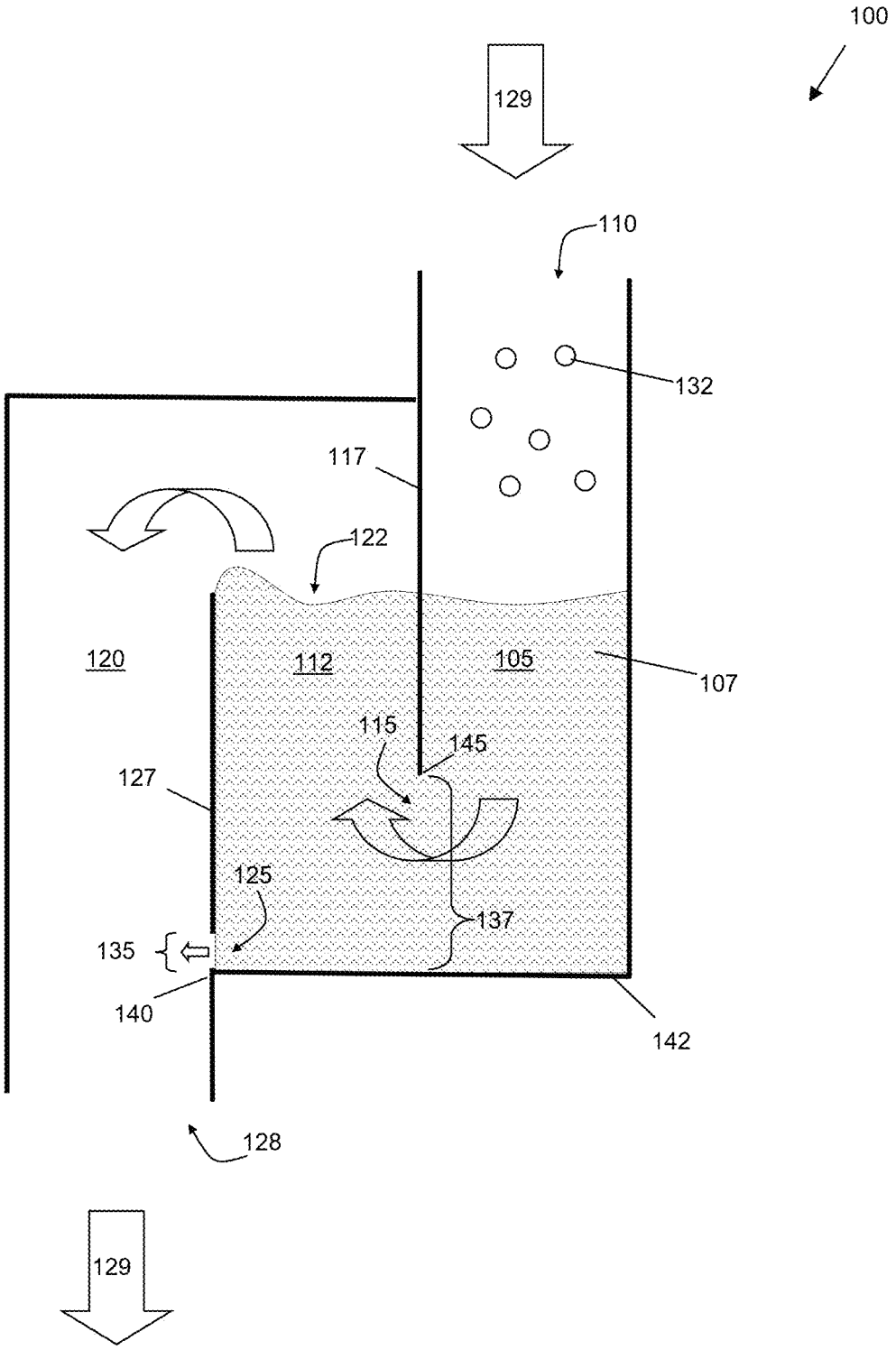
FIG. 1A presents a cross-sectional view of an example embodiment of a condensation trap of the disclosure.

One embodiment of the present disclosure is a condensation trap. FIG. 1A presents a cross-sectional view of an example embodiment of a condensation trap 100 of the disclosure. FIGS. 1B-1F present cross-sectional views of other example embodiments of the condensation trap 100. FIG. 1G presents a cross-sectional view of the condensation trap depicted in FIG. 1F but at a different stage of operation.

As illustrated in FIG. 1A, the condensation trap 100 comprises an inlet chamber 105 configured to receive condensate liquid 107 through a receiving opening 110 therein. The trap 100 also comprises an internal chamber 112 in fluid communication with the inlet chamber 105 via a first internal opening 115 defined by a sidewall 117 shared by the inlet chamber 105 and the internal chamber 112. The first internal opening 115 is located at an opposite end of the inlet chamber 105 from the receiving opening 110. The trap 100 further comprises an outlet chamber 120 in fluid communication with the internal chamber 112 via a second internal opening 122.

The second internal opening 122 is located at an opposite end of the internal chamber 112 from the first internal opening 115. The trap 100 further comprises a bleed orifice 125 located in a sidewall 127 shared by the internal chamber 112 and the outlet chamber 120. At least a portion of the bleed orifice 125 is lateral to first internal opening 115.

The term, lateral to first internal opening 115, as used herein, means that at least a portion of the opening of the bleed orifice 125 lies within any horizontal plane intersecting with a portion of the first internal opening 115.

One of ordinary skill in the pertinent art would understand how the dimensions and internal volumes of the chambers 105, 112, 120 and sizes of inlet opening 110, internal openings 115, 122 and outlet opening 128 would be adjusted to provide sufficient flow throughput 129 of the condensate liquid 107 through the trap 100 depending on the maximum expected flow rate of the condensate liquid 107 into the trap as generated by a heating furnace of an HVAC system that the condensate trap 100 is part of.

The bleed orifice 125 of the trap 100 facilitates bleeding or draining of the trap 100 to provide at least partial drainage, or in some cases full drainage, of the condensate liquid 107 from the inlet chamber 105 and the internal chamber 115. The bleed orifice 125 is located in the sidewall 127 such that after full or partial drainage, an air-gap 130 (FIG. 1B) exists within the first internal opening 115, e.g., when there is no new condensate liquid 107 entering the receiving opening 110. Such full or partial drainage prevents the trap 100 from being fully blocked by frozen condensate in the trap 100 as newly entering condensate liquid 107 fills the air-gap 130 and thereby blocks flue gases 132 from passing through the first internal opening 115.

It is advantageous for the bleed orifice 120 to be configured in the trap 100 such that the first internal opening 115 can rapidly fill with the condensate liquid 107 when the condensate liquid 107 enters the receiving opening 110. That is, the bleed orifice 120 can be sized and located such that the first internal opening 115 can rapidly fill with the condensate liquid 107 such that flue gases 132, generated by a heating furnace of an HVAC system, are rapidly blocked from passing to the outlet chamber 120.

One of ordinary skill in the pertinent arts would be understand that such rapid filling would be defined by the maximum period time permitted for such blocking of the flue gases 132, e.g., as set by industry or government safety or other operating standards. As non-limiting examples, consider standards that require blocking flue gas 132 passage through the trap 100 by 1 minute, 10 minutes or 120 minutes, respectively. In such embodiments, the trap 100 would be configured such that the first internal opening 115 can rapidly fill with the condensate liquid 107 in less than 1 minute, 10 minutes or 120 minutes, respectively, of commencing the operation of a heating subunit (e.g., the commencing of a heating cycle).

In addition to rapidly filling the trap 100 with condensate liquid 107, it is also desirable for the condensate liquid 107 to be drained from the trap 100 through the bleed orifice 125 before the condensate liquid 107 freezes. That is, it is desirable to drain the condensate liquid 107 fast enough that any remaining condensate liquid 107 is below the level of the bleed orifice 125 before the liquid 107 freezes. For instance, if the condensate liquid 107 was in an environment in the trap 100 that would cause freezing in about 1 minute or about, 10 minute, then the bleed orifice 125 can drain the condensate liquid 107 below the level of the bleed orifice 125 in less than 1 minute or 10 minutes, respectively.

Sufficient rapid filling the first internal opening 115 and fast drainage through the bleed orifice 125 depend upon multiple factors, such as: the rate of the condensate liquid 107 delivery to input opening 110; the internal volume of the trap 100 up to the top of the first internal opening 115; the freezing rate of the condensate liquid 107; the relative sizes of the first internal opening 115 and the bleed orifice 125; and the location of the bleed orifice 125.

The rate of the condensate liquid 107 delivery to the trap 100, in turn, can depend on the size of the heating subunit of the HVAC system that combusts the fuel and the fuel being combusted. The freezing rate of the condensate liquid 107, in turn, can depend on the installation location of the HVAC system and the ambient temperature surrounding the trap 100.

In some embodiments, the relative sizes of the first internal opening 115 and the bleed orifice 125 may be conveniently adjusted to provide the desired fill and drainage rate characteristics to accommodate a particular combination of heating subunit and installation environment.

For instance, in some embodiments of the trap 100, the bleed orifice 125 has a cross-sectional area 135 that is less than a cross-sectional area 137 of the first internal opening 115 such that the condensate liquid 107 accumulates in the internal chamber 112 and the majority of the condensate liquid 107 passes from the internal chamber 112 to the outlet chamber 120, via the second internal opening 122, when the condensate liquid 107 is entering the receiving opening 110.

As non-limiting examples, in some embodiments, the ratio of the cross-sectional area 137 of the first internal opening 115 to the cross-sectional area 135 of the bleed orifice 125 is in a range of about 5:1 to 10:1. In some embodiments, the ratio of the cross-sectional area 137 of the first internal opening 115 to the cross-sectional area 135 of the bleed orifice 125 is in a range of about 10:1 to 20:1. In some embodiments, the ratio of the cross-sectional area 137 of the first internal opening 115 to the cross-sectional area 135 of the bleed orifice 125 is in a range of about 20:1 to 50:1. For example, when the cross-sectional area 137 of the first internal opening 115 equals about 1 $cm^2$ then, in some embodiments, the bleed orifice 125 has a cross-sectional area 135 in a range of about 0.1 to 0.2 $cm^2$, and in some embodiments, about 0.05 to 0.1 $cm^2$, and in some embodiments, about 0.02 to 0.05 $cm^2$. Based upon these examples, one of ordinary skill would understand that other area values and ratios of the cross-sectional areas 135, 137 could be selected within the scope of the present disclosure.

In some embodiments, the location of the bleed orifice 125 may be conveniently adjusted to provide the desired fill and drainage rate characteristics to accommodate a particular combination of heating subunit and installation environment.

For example, as illustrated in FIG. 1A, in some embodiments of the trap 100, the bleed orifice 125 can be positioned in the sidewall 127 shared by the internal chamber 112 and the outlet chamber 120 such that a bottom portion 140 of the bleed orifice 125 is located lateral to a bottom wall 142 shared by the inlet chamber 105 and the internal chamber 112. To be lateral to the first internal opening 115 the bleed orifice 125 is also located below a bottom end 145 of the sidewall 117 shared by the inlet chamber 105 and the internal chamber 112.

Locating the bleed orifice 125 lateral to the bottom wall 142 can facilitate increasing the drainage rate of the condensate liquid 107 through the bleed orifice 125 as the pressure differential between the orifice 125 location and the top level of the condensate liquid 107 in the trap 100 is increased as compared to embodiments (FIG. 1B) where the orifice 125 located higher than the bottom wall 142. Locating the bleed orifice 125 lateral to the bottom wall can also advantageously facilitate the full drainage of condensate liquid 107 from the trap and thereby avoid substantial amounts of frozen condensate forming in the trap, although some residual amounts of frozen condensate may still be present on the bottom wall 142 after draining. Locating the bleed orifice 125 lateral to the bottom wall 142 can also advantageously facilitate the removal of any solid debris (e.g., dust, microorganisms and other small particles that may accumulate inside the trap 100 on the bottom wall 142, e.g., during a season of use.

Figure 1B:
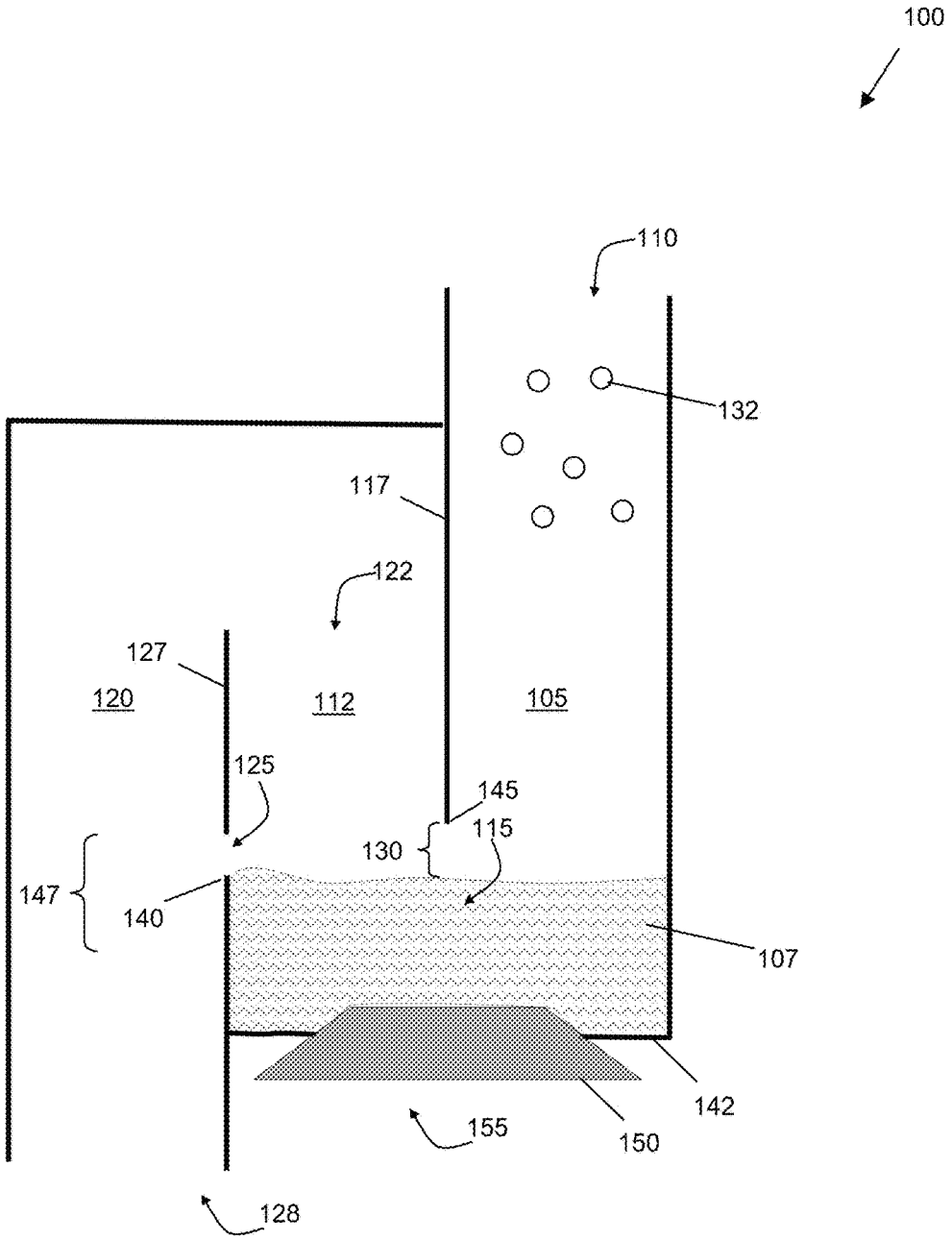
FIG. 1B presents a cross-sectional view of another example embodiment of a condensation trap of the disclosure.

Alternatively, as illustrated in FIG. 1B, in some embodiments of the trap 100, the bleed orifice 125 is positioned in the sidewall 127 shared by the internal chamber 112 and the outlet chamber 120 such that the bleed orifice 125 is located above the bottom wall 142 shared by the inlet chamber 105 and the internal chamber 112. That is, the bottom portion 140 of the bleed orifice 125 is located below a bottom end 145 of the sidewall 117 shared by the inlet chamber 105 and the internal chamber 112, such that bleed orifice 125 is lateral to the first internal opening 115.

Locating the bleed orifice 125 lateral to the bottom wall 142 can decrease the drainage rate of the condensate liquid 107 through the bleed orifice 125 since the pressure differential between the orifice 125 location and the top level of the condensate liquid 107 is decreased as compared to locating the orifice 125 lateral to the bottom wall 142. Locating the bleed orifice 125 above the bottom wall 142, however, can advantageously facilitate partial drainage of condensate liquid 107 from the trap 100. In some such embodiments, frozen condensate may accumulate in the trap 100, e.g., up to a level lateral to the bottom portion of 140 of the bleed orifice 125. However, the air gap 130 between the frozen condensate 172 and the bottom portion 145 of the sidewall 117, allows new liquid condensate 107 entering the receiving opening 110 (e.g., after the heating subunit recommences operation) to rapidly fill the trap 100 and prevent flue gas 132 from passing through the first internal opening 115. New liquid condensate 107 entering the receiving opening 110, e.g., generated upon commencing a heating operation, would facilitate melting of any frozen condensate 172 accumulated on the bottom wall 142. Locating the bleed orifice 125 above the bottom wall 142 can also advantageously avoid having debris accumulated on the bottom wall 142 from clogging the bleed orifice 125. For instance, in some embodiments, to help avoid such accumulated debris from reaching up to the level of the bleed orifice 125, the bleed orifice 125 can located in an upper half 147 of the sidewall 127 shared by the internal chamber 112 and the outlet chamber 120 and that is lateral to the first internal opening 115, i.e., located below a bottom end 145 of the sidewall 117 shared by the inlet chamber 105 and the internal chamber 112.

In some embodiments, as further illustrated in FIG. 1B, to facilitate periodic removal of such debris, e.g., debris accumulated over a period (e.g., a season) of use, the trap 100 can further including a clean-out port 150 located in an opening 155 of the bottom wall 142 shared by the inlet chamber 105 and the internal chamber 112.

Figure 1C:
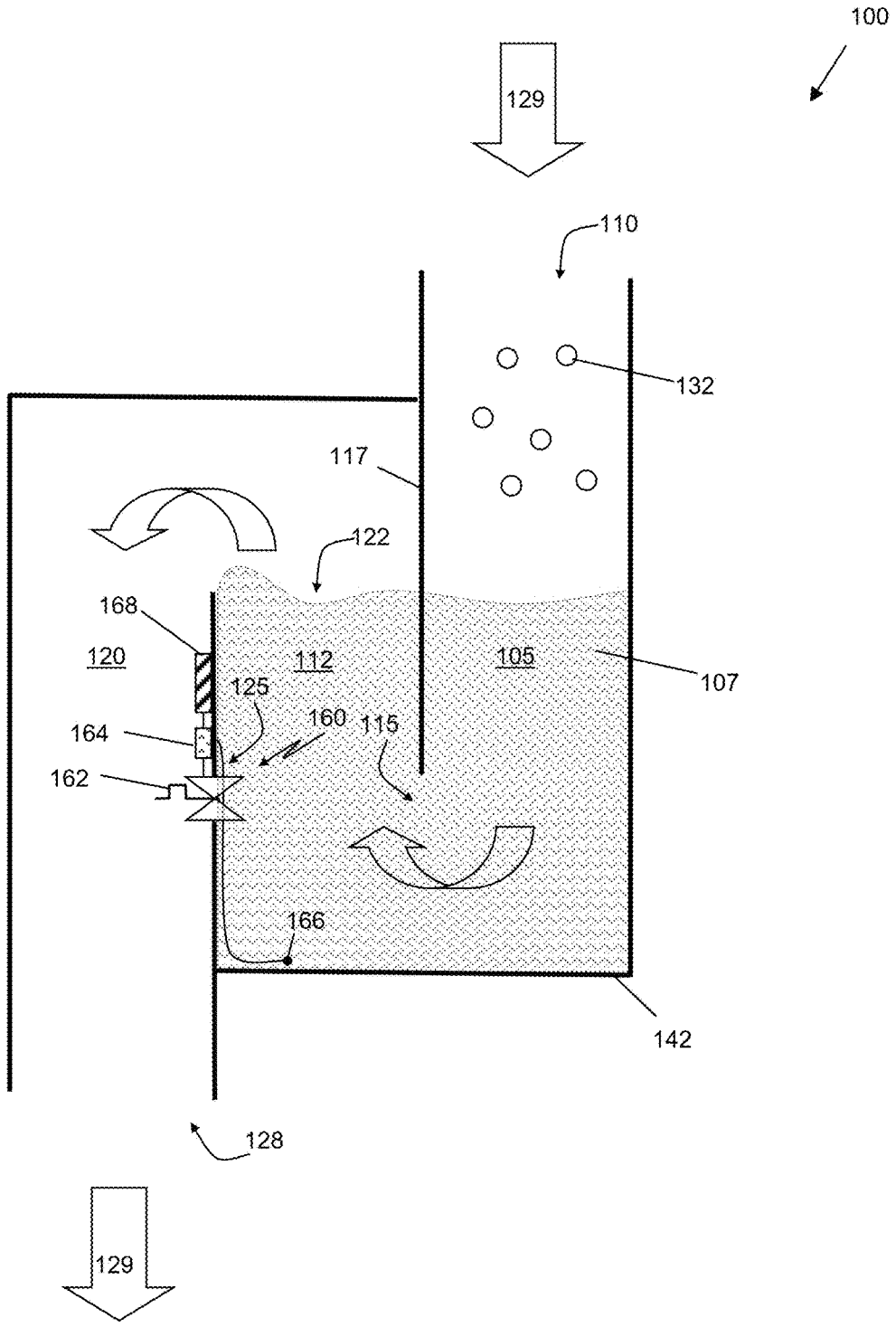
FIG. 1C presents a cross-sectional view of another example embodiment of a condensation trap of the disclosure further including an example bleed valve.
Figure 1D:
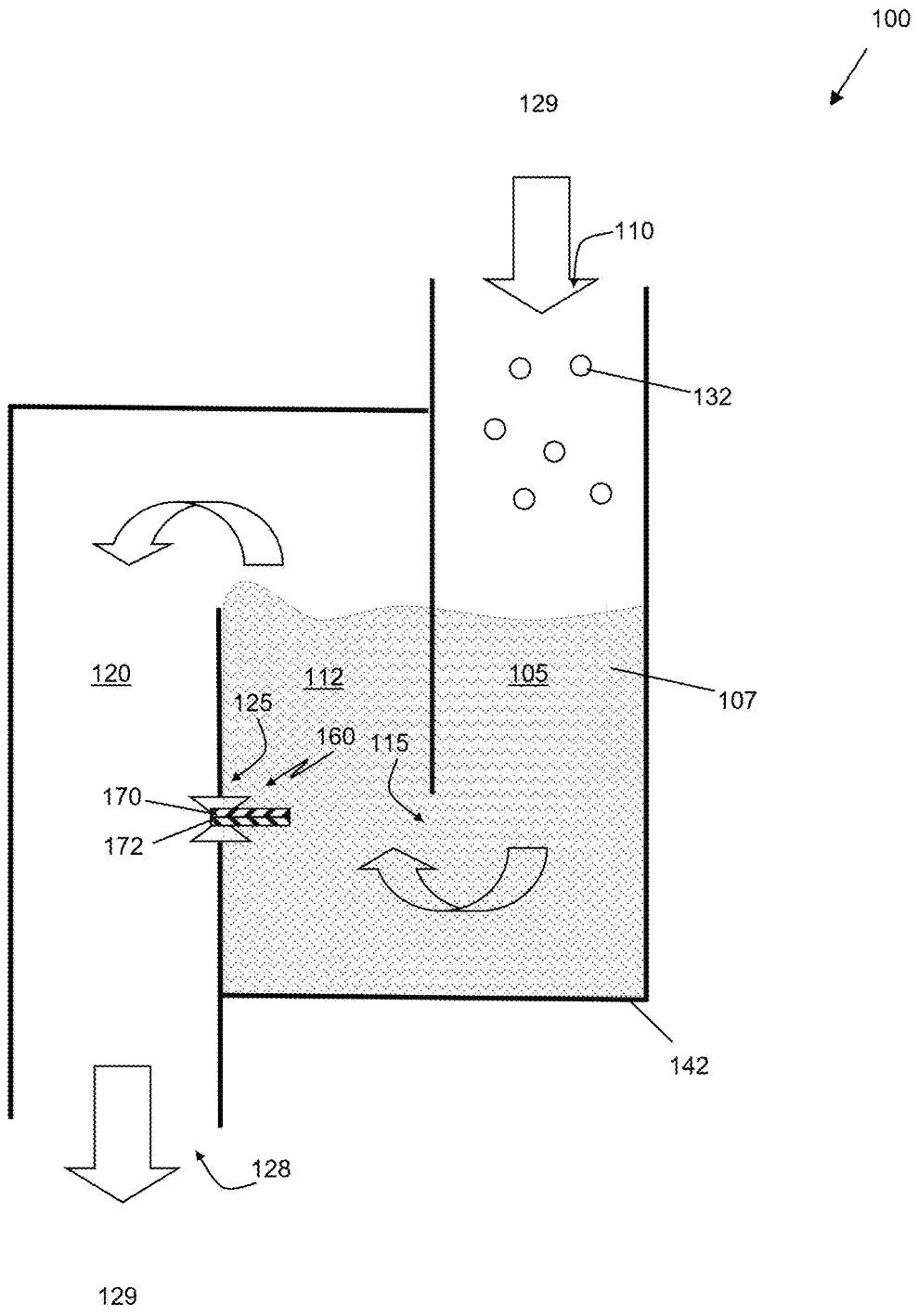
FIG. 1D presents a cross-sectional view of another example embodiment of a condensation trap of the disclosure further including an alternative example bleed valve.

As illustrated in FIGS. 1C and 1D, some embodiments of the trap 100 can further include a bleed valve 160 coupled to the bleed orifice 125. The embodiment depicted in FIG. 1C shows the bleed orifice 125 located above the bottom wall 142. In other embodiments, a bleed valve 160 could be used when the bleed orifice 125 is located lateral to the bottom wall 142 such as discussed above in the context of FIG. 1A.

In some such embodiments, the bleed valve 160 can be configured to be in a closed state above a predefined freeze-alert temperature, and, configured to be in an open state at or below the predefined freeze-alert temperature, wherein the condensate liquid 107 accumulated in the trap cannot pass through the bleed orifice 125 in the closed state and the condensate liquid 107 accumulated in the trap can pass through the bleed orifice 125 in the open state.

In some embodiments, the predefined freeze-alert temperature is a value greater (e.g., about 1° F. greater, about 2° F. greater or about 5° F. greater, in different embodiments) than a freezing point of the condensate liquid 107 (e.g., about 32° F.)

Having a temperature-controlled bleed value 160 can facilitate providing sufficient condensate liquid 107 to fill the first internal opening 115 except during environmental condition where the condensate liquid 107 can freeze. The temperature-controlled bleed value 160 facilitates retaining condensate liquid 107 such that the first internal opening 115 can be filled, and thereby block the passage of flue gases 132 through the first internal opening 115 even immediately upon a commencing a furnace operation with combustion of fuel in the heating subunit, without having to first refill the partially or fully drained trap 100 to cover the first internal opening 115 with condensate liquid 107.

In some embodiments, providing a bleed valve 160 can facilitate the use of a larger size bleed orifice 125 than the desired ratio of the cross-sectional area 137 of the first internal opening 115 to the cross-sectional area 135 of the bleed orifice 125 with no valve 160, such as discussed above in the context of FIG. 1A. For illustrative purposes, consider an embodiment of the trap 100 where the desired ratio of cross-sectional areas 137, 135 of the first internal opening 115 to the bleed orifice 125, with no valve, equaled about 200:1 and the cross-sectional area 137 of the first internal opening 115 equaled about 1 $cm^2$. In such an embodiment, the cross-sectional area 137 of the bleed orifice 125 would equal about 0.005 $cm^2$, corresponding an about 700 micron by 700 micron square orifice or about 790 micron diameter circular orifice. For illustrative purposes, consider for some embodiments, it may be difficult to mass-produce traps 100 having such an orifice 125 size within a desired tolerance range (e.g., a target orifice cross-sectional area 135 ±10 percent or ±1 percent). Alternatively, or additionally, for illustrative purposes, consider that for some embodiments, such a small orifice 125 size may be prone to being plugged by debris. For such illustrative embodiments, it can be advantageous to provide a larger sized bleed orifice 125 (e.g., about 0.02 $cm^2$ or about 0.1 $cm^2$) coupled to a valve 160 and therefore, not as prone to not meeting manufacturing tolerances or being plugged by debris.

As further illustrated in FIG. 1C, some embodiments of the trap 100 can include an electrically powered bleed valve 160. As an example, the bleed valve 160 can be coupled to an electrically powered actuator 162 that is controlled by a control module (e.g., an integrated circuit) 164. A temperature sensor 166 coupled to the control module 164 can be configured measure the ambient temperature surrounding the trap 100 or the temperature of the condensate liquid 107 in the trap 100 and transfer such measurements to the control module 164. The controller (e.g., an integrated circuit) can receive measured temperature data from the sensor and compare the temperature data to the predefined freeze-alert temperature. When the measured temperature drops to a value equal to the predefined freeze-alert temperature the control module 164 can be programmed to send a control signal to the actuator 162 to actuate the value 160 such that the bleed orifice 125 is open to the internal chamber 112. When the measured temperature increase above the predefined freeze-alert temperature, the control module 164 can be programmed to send another control signal to the actuator 162 to actuate the value 160 such that the bleed orifice 125 is closed to the internal chamber 112. Based on the present disclosure one skilled in the pertinent arts would appreciate how variations of electrically powered bleed valves 160 could be employed in the trap 100.

Although electrical power is required for the electrically powered bleed valve 160 discussed in the context of FIG. 1C, the amount of power required to operate the valve 160 can be substantially (e.g., orders of magnitude) less power than the electrical power required to generate resistive heating for heating tape coupled to the trap 100, or other resistive heating device, over the course of a season. For instance, in some embodiments, the electrical power electrically powered bleed valve 160 may be provided by a battery 168 such as small 1.5 to 9 Volt battery.

Alternatively, in some embodiments, such as illustrated in FIG. 1D, it can be advantageous to use a bleed valve 160 that does not require electrically power to open and close the valve 160. For instance, some embodiments of the trap 100, can include a bleed valve 160 that is a non-electrically powered temperature control valve. For example some embodiments of the non-electrically powered temperature control valve 160 can include a bi-layer 170, 172 of two different metals that have two different coefficients of thermal expansion. The bilayer 170, 172 can be configured such that, when the temperature of the valve 160 changes (e.g., dropping below the predefined freeze-alert temperature), the first metal layer 170 and second metal layer 172 expand or contract to different amount per degree of temperature change, thereby causing the bilayer 170, 172 to move (e.g., rotational movement, movement in one, two or three dimensions in various embodiments). The bilayer 170, 172 can thereby be configured such that the movement opens and closes the bleed orifice 125. One skilled in the pertinent art would understand how to select the types of metals, and, the thicknesses and lengths of the metal layers 170, 172 to provide the desired degree of motional actuation at the predefined freeze-alert temperature to thereby open or close the bleed orifice 125 to the internal chamber 112.

Figure 1E:
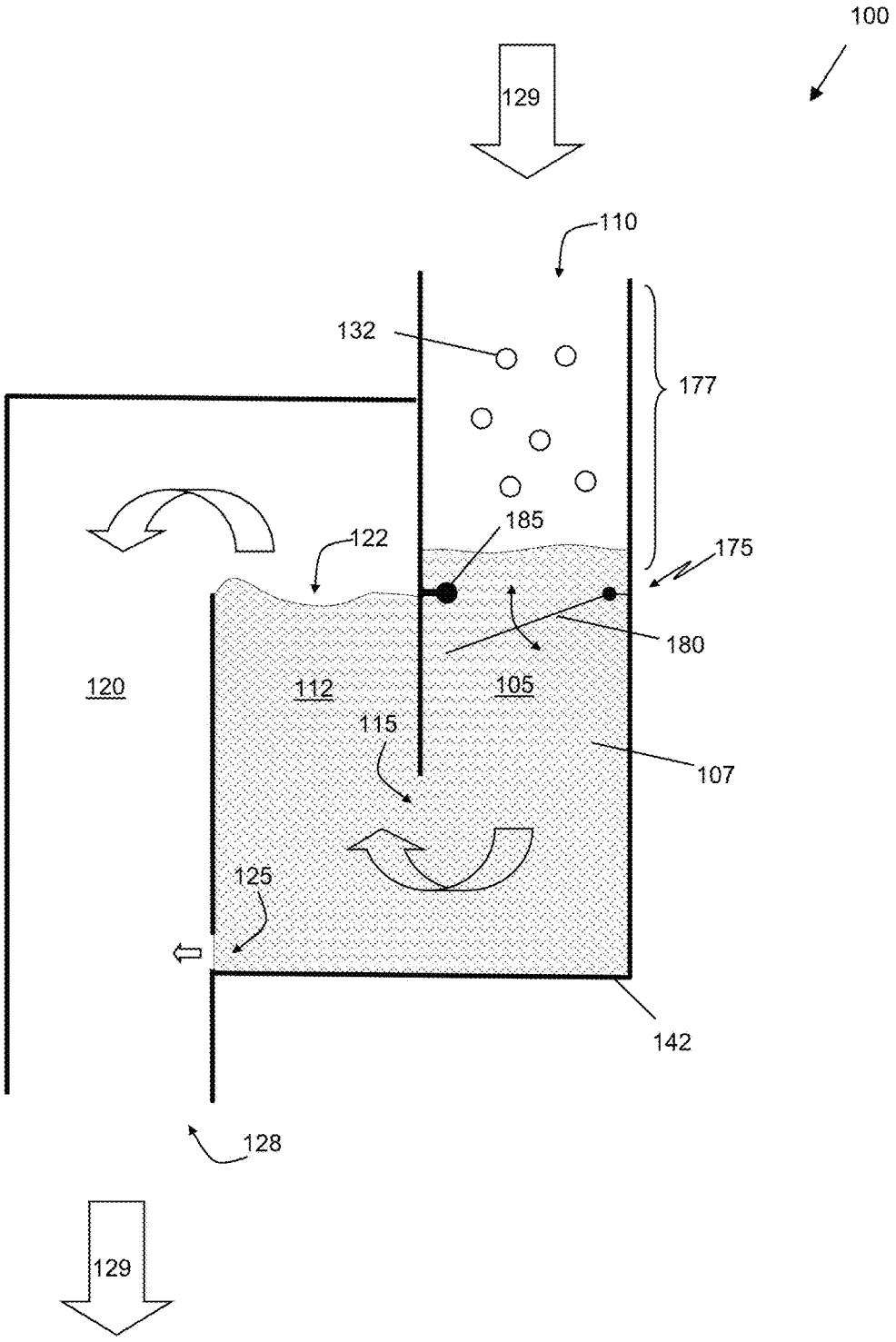
FIG. 1E presents a cross-sectional view of another example embodiment of a condensation trap of the disclosure further including an example mechanical seal.
Figure 1F:
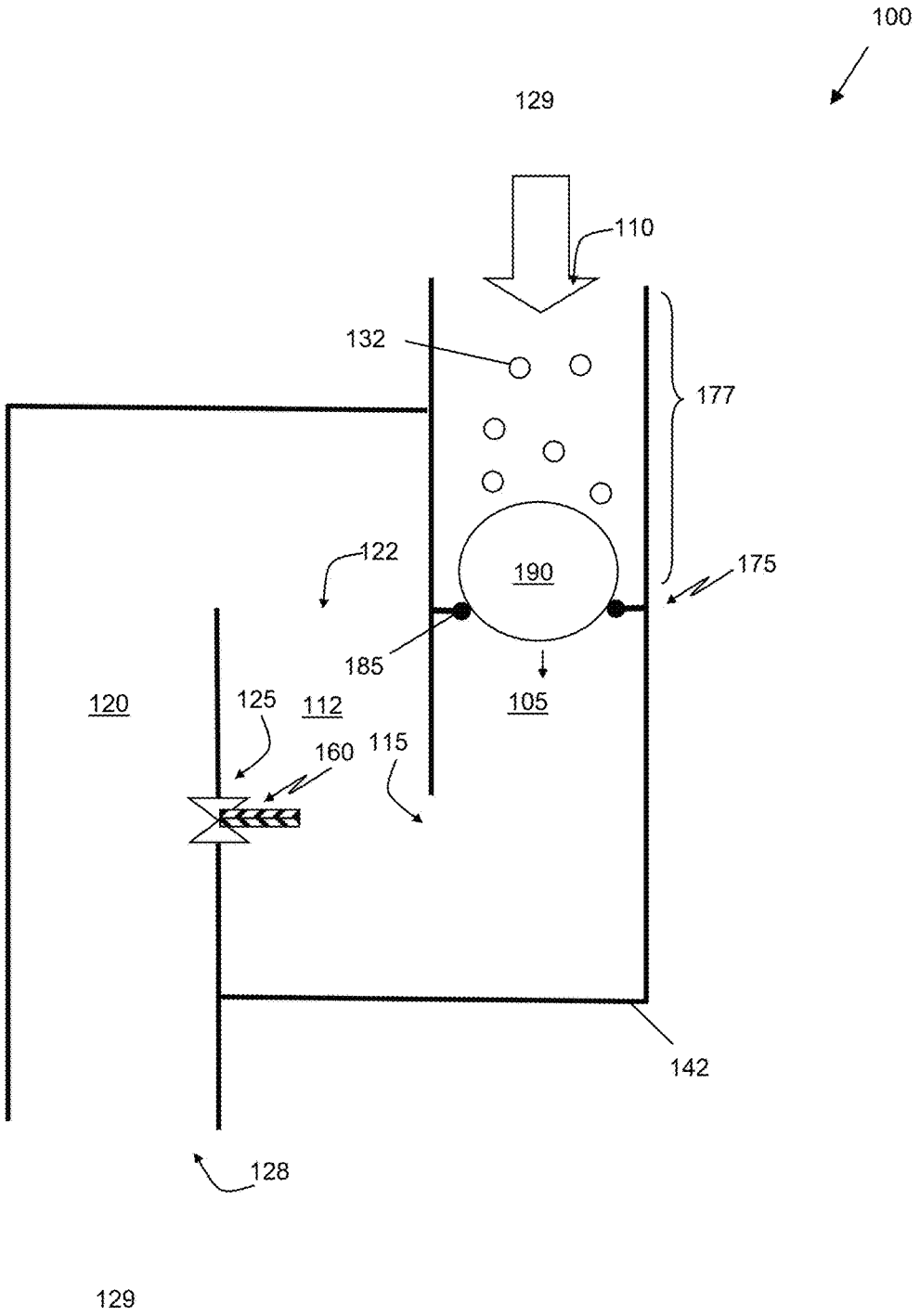
FIG. 1F presents a cross-sectional view of another example embodiment of a condensation trap of the disclosure further including an alternative example mechanical seal.
Figure 1G:
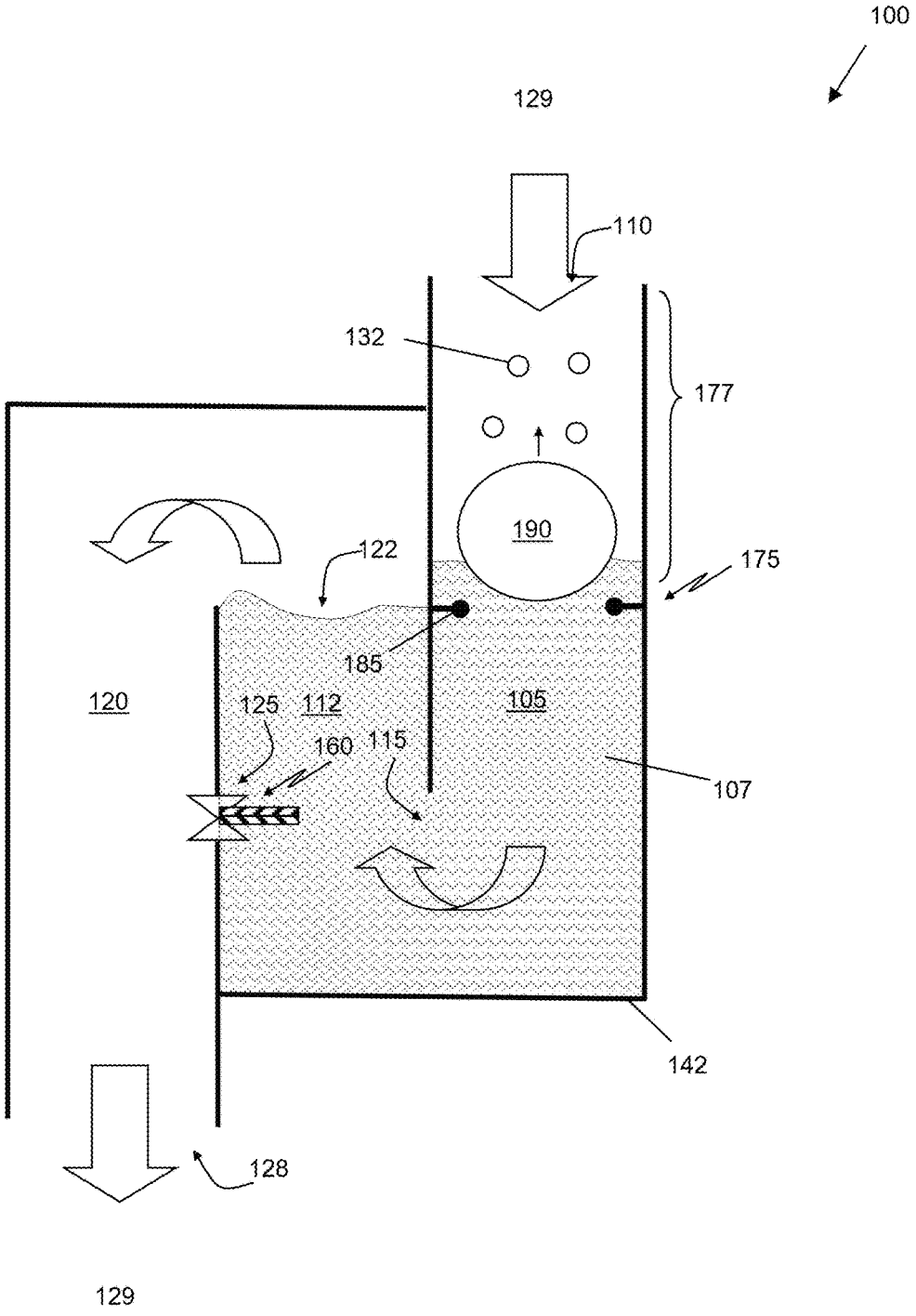
FIG. 1G presents a cross-sectional view of the condensation trap depicted in FIG. 1F but at a different stage of operation.

As illustrated in FIGS. 1E, 1F and 1G, some embodiments of the trap 100 can further include a mechanical seal 175. Any of the mechanical seal 175 embodiments can be used in any of trap 100 embodiments discussed above in the context of FIGS. 1A-1D. The mechanical seal 175 can be configured to prevents flue gases 132 from passing through the trap 100 when the partially or fully drained trap 100 contains frozen condensate and an air-gap 130 exists within the first internal opening 115 as discussed above in the context of FIG. 1A. The inlet chamber 105 further includes a mechanical seal 175 that can be configured to be in a closed state when the condensate liquid 107 is not entering the inlet opening 110. The mechanical seal 175 can be configured to be in an open state when a volume of the condensate liquid 107, sufficient to fill the first internal opening 115, has accumulated in an upper chamber portion 177 of the inlet chamber 105 located in-between the inlet opening 110 and the mechanical seal 175.

Thus, in the closed state, the seal 175 can be configured to prevent flue gases 132 from passing through the first internal opening 115 when an HVAC system, connected to the condensate trap, commences a heating operation and flue gases 132 are generated but sufficient amounts of condensate liquid 107 have not yet entered the inlet opening 110 so as to fill the first internal opening 115. In the open state, the seal 175 opens when the accumulated volume of condensate liquid 107 is sufficient to fill the inlet chamber 105 and internal chamber 112 such that the first internal opening 115 can be filled with liquid and thereby blocks flue gases from passing through the opening 115. One of ordinary skill would understand how to configure the mechanical seal 175 such that the seal 175 remains closed when the sufficient volume of condensate liquid 107 has not accumulated, and, to open when the sufficient volume of condensate liquid 107 has accumulated.

For example, as illustrated in FIG. 1E, in some embodiments, the mechanical seal 175 includes a rotating flapper valve 180 configured to provide the inlet chamber 105 with an air-tight seal when the condensate liquid 107 is not entering the receiving opening 110, and, to open when the volume of the condensate liquid 107 has accumulated inside of the inlet chamber 105 (e.g., in the upper chamber portion 177).

In some such embodiments, to facilitate forming the air-tight seal, the rotating flapper valve 180 can be configured to mate with a sealing ring 185 (e.g., a rubberized ring) located within the inlet chamber 105.

In some such embodiments, the rotating flapper valve 180 can be spring-loaded such that the spring is configured to apply a sufficient closing force to provide the air-tight seal (e.g., resistant to the pressure from incoming flue gases 132, but, not enough force to prevent opening of the flapper valve 180 when the sufficient condensate liquid 107 volume has accumulated.

In some such embodiments, the rotating flapper value 180 can be composed of an elastic material. The elastic rotating flapper value 180 can be configured to be pliable when contacted with the condensate liquid 107 and thereby allows the valve 180 to open such that the condensate liquid 107 fills the first internal opening 115, and, to become rigid in the absence of the condensate liquid 107 such that the air-tight seal is restored.

Alternatively, as illustrated in FIGS. 1F and 1G, in some embodiments, the mechanical seal 175 includes a float ball valve 190 configured to provide the inlet chamber 105 with an air-tight seal when the condensate liquid 107 is not entering the receiving opening 110 (FIG. 1F) and to float upwards inside of the inlet chamber 105 when the sufficient volume of the condensate liquid 107 has accumulated inside of the inlet chamber 105, e.g., in the upper chamber portion 177 (FIG. 1G).

In some such embodiments, the float ball valve 190 can be configured to mate with a sealing ring 185 located within the inlet chamber 105. One of ordinary skill in the pertinent art would understand how to adjust the buoyancy of the float ball valve 190 such that the float ball valve 190 floats when the sufficient volume of condensate liquid 107 has accumulated in the inlet chamber 105.

Figure 2:
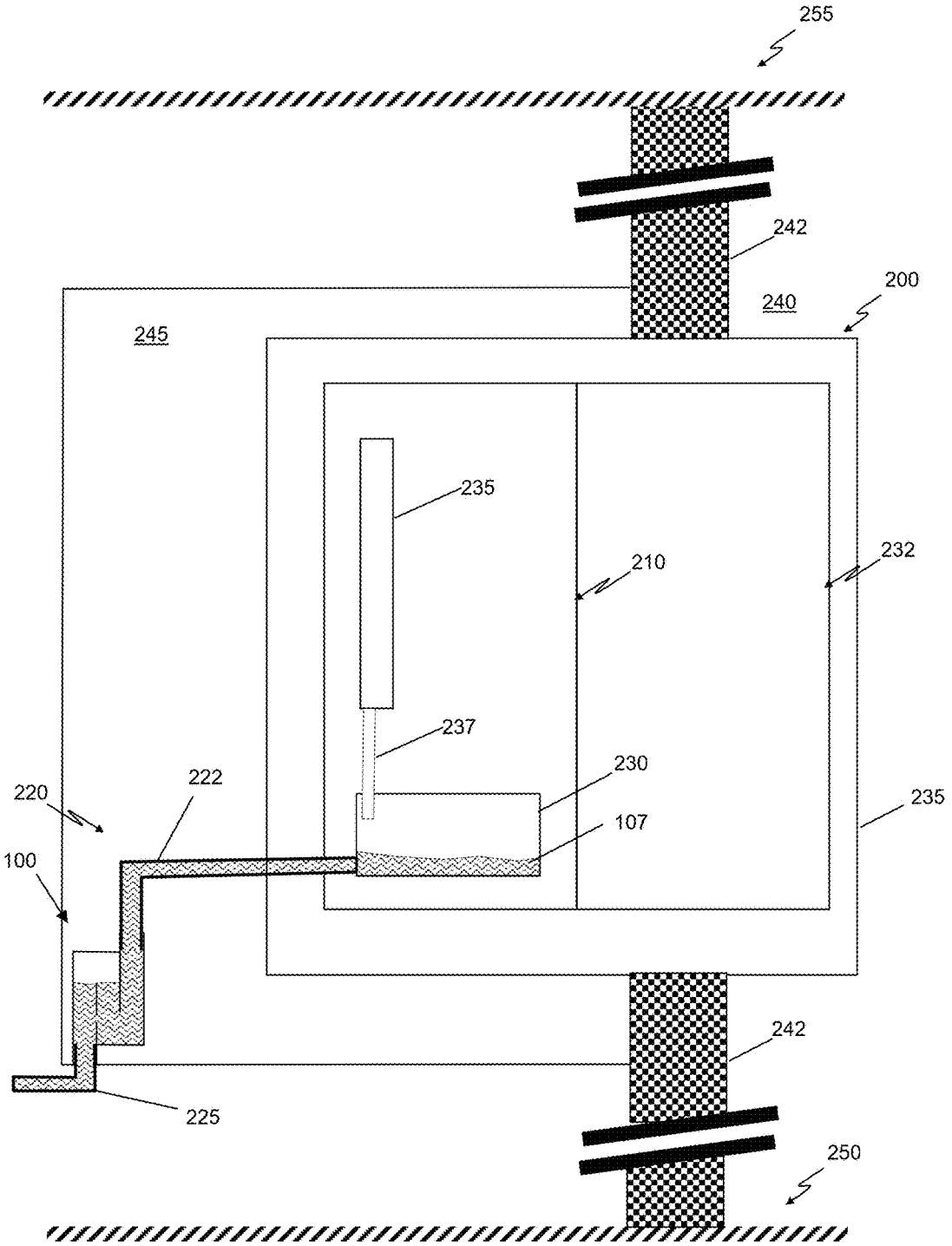
FIG. 2 presents a block diagram of an example HVAC system of the disclosure, the HVAC system including the condensation trap of the disclosure such as any of the condensation traps discussed in the context of FIGS. 1A-1F.

Another embodiment of the disclosure is a HVAC system. FIG. 2 presents a block diagram of an example HVAC system 200 of the disclosure, the HVAC system 200 including the condensation trap 100 of the disclosure.

As illustrated in FIG. 2, and with continuing reference to the FIGS. 1A-1G, HVAC system 200, comprising a heating subunit 210. The heating subunit 210, in operation, combusts fuel and generates condensate liquid 107 as a byproduct of combustion.

The system 200 also comprises a drainage system 220 configured to receive the condensate liquid 107. The drainage system 220 includes a condensate trap, such as any of the condensation traps 100 discussed in the context of FIGS. 1A-1F.

As further illustrated in FIG. 2, embodiments of the drainage system 220 can include an inlet line 222 connected to the receiving opening 110 (e.g., FIG. 1A) and configured to transfer the condensate liquid 107 from the heating subunit 210 to the trap 100. The drainage system 220 can also include an outlet line 225 connected to the outlet opening 128 (e.g., FIG. 1A) of the trap 100 and configured to move the condensate liquid 107 out of the system 200.

In some embodiments, the heating subunit 210 can be a condensing natural gas furnace, which can advantageously provide a higher heating efficiency over non-condensing furnaces. Other embodiments of the heating subunit 210 could include other types of condensing furnaces that combust other hydrocarbon fuels and generate condensate liquid 107 as a byproduct of the combustion.

In some embodiments, the heating subunit 210 can include a condensation collector box 230 configured to collect the condensate liquid 107 generated as the byproduct of fuel combustion. The condensation collector box 230 can be coupled to the inlet line 222 to deliver the collected condensate liquid 107 to the trap 100. For instance, condensate fluid 107 collected in one or more flue pipes 235 of the heating subunit 210 can be coupled to the collection box 230, e.g., via one or more optional flue hoses 237.

Non-limiting examples of condensing furnace heating subunits and combustion box configurations are presented in U.S. Patent Applications 2011/0174202 and 2011/0174289 which are incorporated by reference herein in their entirety.

As further illustrated in FIG. 2, the system 200 further including an electric cooling subunit 232, wherein the heating subunit 210 and the electric cooling subunit 232 are packaged together in a cabinet 235.

In some embodiments of the system 200 the heating subunit 210 and drainage system 220, and in some embodiments electric cooling subunit 232, are packaged in a cabinet 235 configured as a thru-the-wall cabinet 235. In some such embodiments the condensate trap 100 can exposed to outside ambient environmental conditions, e.g., an outside ambient environment subject to temperatures below freezing temperatures. For instance, a portion of thru-the-wall cabinet 235 can be located outdoors 240 (e.g., beyond the outside wall 242 of a building, and, another portion of the cabinet 235 can be located in a non-conditioned space 245 (e.g., a utility closet or room) within the building.

For instance, the system 200 configured in a thru-the-wall cabinet 235 can be one of a plurality of such cabinets, e.g., located in high-rise apartment building. Such packaged cabinet units can provide substantial installation advantages over traditional split HVAC systems, e.g., with indoor heat exchange coils located inside of a building and outdoor coils located outside the build either on the ground 250 or roof top 255 of the building.

Figure 3:
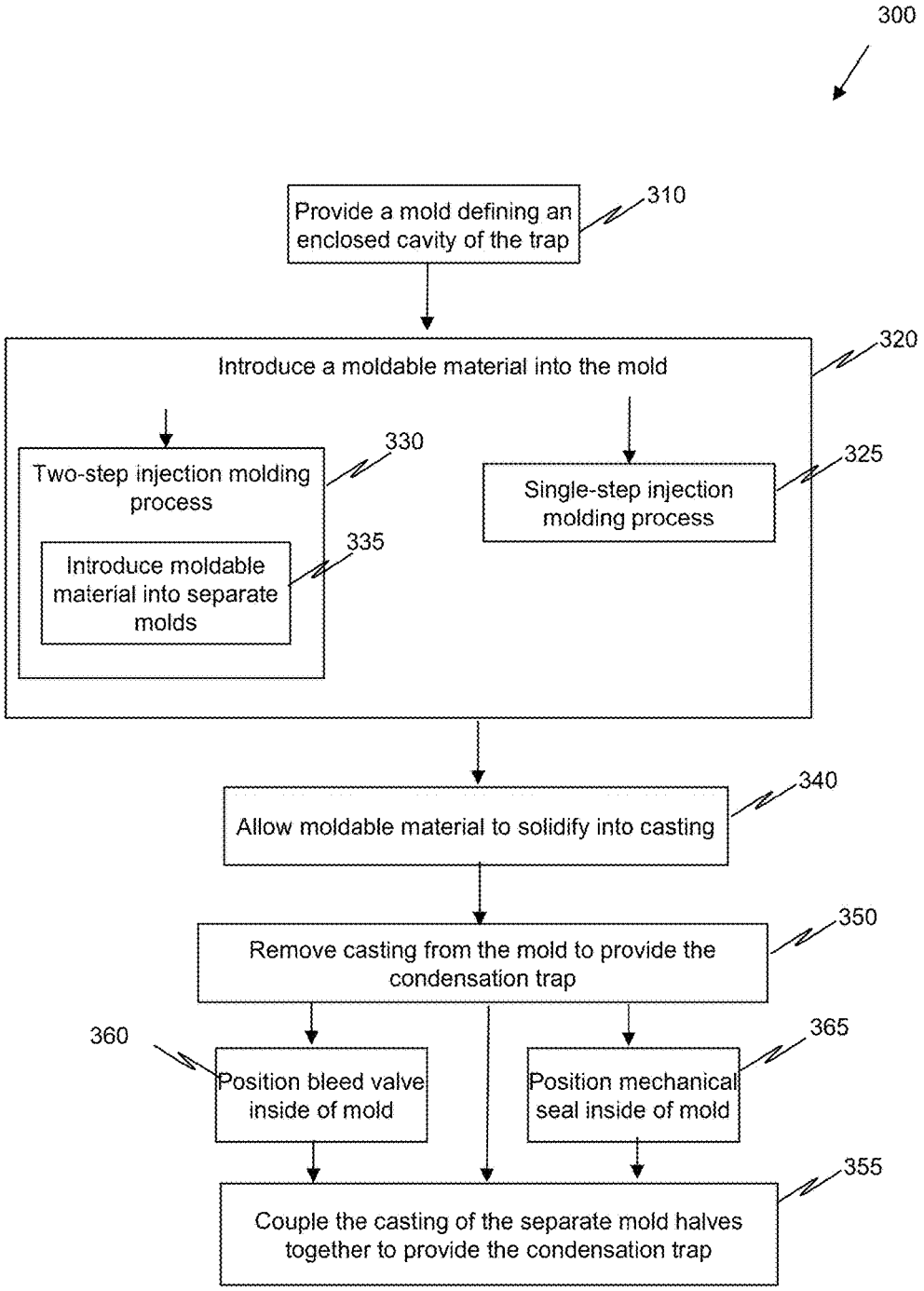
FIG. 3 presents a flow diagram of an example method of manufacturing a condensation trap of the disclosure, such as any of the example traps discussed in the context of FIGS. 1A-2.

Another embodiment of the present disclosure is a method of manufacturing a condensation trap. FIG. 3 presents a flow diagram of an example method 300 of manufacturing a condensation trap of the disclosure, such as any of the embodiments of the traps 100 discussed in the context of FIGS. 1A-2, selected components of which are referred to below.

The method 300 comprises a step 310 of providing a mold that defines an enclosed cavity that defines the structure of the trap 100. The enclosed cavity includes the inlet chamber 105, internal chamber 112, first internal opening 115, outlet chamber 120, second internal opening 122 and bleed orifice 125 configured as described above for any of the embodiments, or combinations thereof, discussed in the context of FIGS. 1A-2. One of ordinary skill in the pertinent art would understand how to fabricate such molds, e.g., by machining and including internal inserts as needed to define the chambers 105, 112, 120, openings 110, 115, 122, 128, bleed orifice 125, and other structures of the trap 100.

The method 300 further comprises a step 320 of introducing a moldable material into the mold. In some embodiments, a moldable material comprising a polymer powder (e.g., PVC power or PVC powder alloyed with other polymers or plasticizers) can be heated and mixed to a homogenous flowable state and then introduced into the mold in accordance with step 320 by transferring the moldable material into the enclosed cavity.

In some embodiments, the introduction step 320 can further include a single-step injection-mold process 325. The single-step injection molding process (step 325) can provide substantial time and cost savings as compared to alternative processes where, e.g., individual parts of the trap are individually molded and then coupled together.

Such embodiment of the method 300 further comprises a step 340 of allowing the moldable material to solidify into a casting, and, a step 350 of removing the casting from the mold, e.g., to provide the condensation trap 100.

Alternatively, in other embodiments, the step 320 of introducing a moldable material into the mold (step 320) includes a two-step molding process 330, including introducing the moldable material, in step 335, into separate molds corresponding to different halves of the trap 100. Then after steps 340 and 350, in step 355, the separate castings of the molded halves are coupled together, e.g., to provide the condensation trap 100.

Embodiments of the coupling step 355 can include, for example, chemical bonding (e.g., with glue or other adhesive), vibration or thermal welding bonding, mechanically fitting the halves together, or combination of one or more of these coupling processes, as familiar to those skilled in the pertinent art.

In some embodiments prior to the coupling step 355, a bleed valve 160 (step 360) or a mechanical seal 175 (step 365), or both the valve 160 and seal 175, can be positioned inside of the mold halves.

Those skilled in the art to which this application relates will appreciate that other and further additions, deletions, substitutions and modifications may be made to the described embodiments.

What is claimed is:

1. A condensate trap, comprising:

an inlet chamber configured to receive condensate liquid through a receiving opening therein, the inlet chamber comprising a bottom wall;

an internal chamber in fluid communication with the inlet chamber via a first internal opening defined by a sidewall shared by the inlet chamber and the internal chamber and further defined by the bottom wall, the first internal opening located at an opposite end of the inlet chamber from the receiving opening;

an outlet chamber in fluid communication with the internal chamber via a second internal opening located at an opposite end of the internal chamber from the first internal opening; and a bleed orifice located in a sidewall shared by the internal chamber and the outlet chamber, wherein at least a portion of the bleed orifice is lateral to first internal opening;

wherein the bottom wall comprises a bottom edge of both the inlet chamber and the internal chamber; and wherein the bleed orifice has a cross-sectional area that is less than a cross-sectional area of the first internal opening and that is less than a cross-sectional area of the second internal opening.

2. The condensate trap of claim 1, wherein the bleed orifice is configured such that the first internal opening is rapidly filled with the condensate liquid when the condensate liquid enters the receiving opening.

3. The condensate trap of claim 1, wherein the bleed orifice is positioned in the sidewall shared by the internal chamber and the outlet chamber such that a bottom portion of the bleed orifice is located lateral to a bottom wall shared by the inlet chamber and the internal chamber.

4. The condensate trap of claim 1, wherein the bleed orifice is positioned in the sidewall shared by the internal chamber and the outlet chamber such that the bleed orifice is located above a bottom wall shared by the inlet chamber and the internal chamber.

5. The condensate trap of claim 1, wherein the bleed orifice is located in an upper half of a portion of the sidewall shared by the internal chamber and the outlet chamber that is lateral to the first internal opening and below a bottom end of the sidewall shared by the inlet chamber and the internal chamber.

6. The condensate trap of claim 1, further including a clean-out port located in a bottom wall shared by the inlet chamber and the internal chamber.

7. The condensate trap of claim 1, further including a bleed valve coupled to the bleed orifice wherein the bleed valve is configured to be in a closed state above a predefined freeze-alert temperature, and, configured to be in an open state at or below the predefined freeze-alert temperature, wherein the condensate liquid accumulated in the trap cannot pass through the bleed orifice in the closed state and the condensate liquid accumulated in the trap can pass through the bleed orifice in the open state.

8. The condensate trap of claim 7, wherein the predefined freeze-alert temperature is greater than a freezing point of the condensate liquid.

9. The condensate trap of claim 7, wherein the bleed valve is a non-electrically powered temperature control valve.

10. The condensate trap of claim 1, wherein the inlet chamber further include a mechanical seal that is configured to be in a closed state when the condensate liquid is not entering the inlet opening, and, the mechanical seal is configured to be in an open state when a volume of the condensate liquid sufficient to fill the first internal opening has accumulated in the inlet chamber in-between the inlet opening and the mechanical seal.

11. The condensate trap of claim 10, wherein the mechanical seal includes a rotating flapper valve configured to provide the inlet chamber with an air-tight seal when the condensate liquid is not entering the receiving opening and to open when the volume of the condensate liquid has accumulated inside of the inlet chamber.

12. The condensate trap of claim 10, wherein the mechanical seal includes a float ball valve configured to provide the inlet chamber with an air-tight seal when the condensate liquid is not entering the receiving opening and to float upwards inside of the inlet chamber when the sufficient volume of the condensate liquid has accumulated inside of the inlet chamber.

13. An HVAC system, comprising:

a heating subunit, wherein the heating subunit in operation, combusts fuel and generates condensate liquid as a byproduct of combustion;

a drainage system configured to receive the condensate liquid, wherein the drainage system includes a condensate trap, the condensate trap includes:

an inlet chamber configured to receive the condensate liquid through a receiving opening therein, the inlet chamber comprising a bottom wall;

an internal chamber in fluid communication with the inlet chamber via a first internal opening defined by a sidewall shared by the inlet chamber and the internal chamber, and further defined by the bottom wall, the first internal opening located at an opposite end of the inlet chamber from the receiving opening;

an outlet chamber in fluid communication with the internal chamber via a second internal opening located at an opposite end of the internal chamber from the first internal opening;

a bleed orifice located in a sidewall shared by the internal chamber and the outlet chamber, wherein at least a portion of the bleed orifice is lateral to first internal opening; and wherein the bleed orifice has a cross-sectional area that is less than a cross-sectional area of the first internal opening and that is less than a cross-sectional area of the second internal opening.

14. The system of claim 13, wherein the heating subunit is a condensing natural gas furnace which provides the advantage of higher heating efficiency over non-condensing furnaces however the heating subunit could include other types of furnaces that combust fuels and generate condensate liquid as a byproduct of the combustion.

15. The system of claim 14, further including an electric cooling subunit, wherein the heating subunit and the electric cooling subunit are packaged together in a cabinet.

16. The system of claim 13, wherein the heating subunit and drainage system are packaged in a cabinet as a thru-the-wall cabinet unit wherein the condensate trap is exposed to outside ambient environmental conditions.

* * * * *